US005353558A

United States Patent [19]

Shea, Sr. et al.

[11] Patent Number: 5,353,558

[45] Date of Patent: Oct. 11, 1994

[54] MANUFACTURED HOUSE UNIT

[75] Inventors: James F. Shea, Sr.; Brian J. Shea, both of Nappanee, Ind.

[73] Assignee: Fairmont Homes, Inc., Nappanee, Ind.

[21] Appl. No.: 996,319

[22] Filed: Dec. 23, 1992

[51] Int. Cl.[5] ..... E04B 1/343; E04B 7/16

[52] U.S. Cl. ..... 52/143; 52/79.1; 52/79.7; 52/741.4; 52/745.16; 52/745.21; 52/64

[58] Field of Search ..... 52/143, 79.1, 79.9, 52/79.12, 64, DIG. 3, DIG. 11, 745.2, 745.16, 79.8, 79.7, 741.4, 745.21

[56] References Cited

U.S. PATENT DOCUMENTS

| | | | |
|---|---|---|---|
| 1,156,693 | 10/1915 | Koger | 52/79.7 X |
| 2,706,313 | 4/1955 | Radman | 52/79.9 |
| 2,893,066 | 7/1959 | Perdue | 52/79.8 |
| 2,990,588 | 7/1961 | McKinley | 52/143 |
| 3,157,427 | 11/1964 | Reynolds | 52/79.9 X |
| 3,233,935 | 2/1966 | Brindle | 52/143 X |
| 3,697,098 | 10/1972 | Fisher | 52/143 X |
| 4,015,375 | 4/1977 | Lindsay | 52/143 |
| 4,275,533 | 6/1981 | Wright | 52/79.1 |
| 4,501,098 | 2/1985 | Gregory | 52/79.1 |
| 4,512,120 | 4/1985 | Lindal | 52/143 X |

FOREIGN PATENT DOCUMENTS 0597294 2/1948 United Kingdom .

OTHER PUBLICATIONS

Drawing Showing Two Separate Sections of Prior Art Manufactured House Being Mated.

*Primary Examiner*—Carl D. Friedman
*Assistant Examiner*—Robert J. Canfield

[57] ABSTRACT

A manufactured house unit is provided which includes multiple separable sections which are matingly receivable to form a house at the erection site. One or more common structural members, such as the roof and/or an exterior wall, join these sections during manufacture to facilitate alignment of interior walls and features during final erection. This arrangement also facilitates transportation of the house to the dealer and/or erection site. Each section may be of different length and the towing hitch arrangement is disposed to facilitate installation of a patio or porch platform. Additional carriage elements are included under each section to enable separate transportation of each section after the common structural member is divided.

10 Claims, 6 Drawing Sheets

MANUFACTURED HOUSE UNIT

BACKGROUND AND SUMMARY OF THE INVENTION

This invention relates generally to manufactured and modular housing and, more particularly, to double wide or sectional manufactured housing.

Double wide manufactured housing typically comprises two halves or sections which are transported to the home or erection site and then mated together at that site to form a completed house. Sectional manufactured and modular housing typically comprises two or more sections. Accordingly, reference to "sectional manufactured or modular housing" encompasses what has traditionally been known as "double wide" manufactured housing. It should be clearly understood that the present invention is applicable to all sectional manufactured and modular housing.

Road transportation of sectional manufactured and modular housing often presents unique problems from a regulatory standpoint and for safety reasons. Such houses typically include sections as wide as sixteen feet. Thus, special transportation precautions must be observed and expenses incurred when transporting these sections on highways and roads. For example, when each section is transported separately on its own undercarriage, separate lead and chase vehicles, permits and insurance are required. However, when the sections are transported on a single, reusable platform, special loading and unloading equipment is required.

During manufacture, these sections also present unique concerns. Each section is separately assembled. In order to be sure each section will properly mate when completed, the sections are pushed together during the manufacturing process. Thus, considerable floor space is required during assembly, as compared with the floor space required to produce a single wide building.

Another shortcoming with prior sectional manufactured and modular housing is the limited number of house configurations available. Usually, for example, such houses involve sections of equal length which are simply assembled to form a square or rectangular finished house. Also, to add a porch or patio deck onto the finished house typically requires separate footings or foundation for support.

Accordingly, an object of the present invention is to provide improved sectional manufactured and modular housing, particularly with respect to minimizing transportation expenses.

Another object is the provision of a process for making sectional manufactured and modular housing sections with less expense.

A further object is to permit greater permutations of design in sectional manufactured and modular housing and to simplify inclusion of patios and porches thereto.

Other objects, advantages and novel features of the present invention will now become apparent to those of skill in the art upon review of the following drawings and detailed description of preferred embodiments.

DETAILED DESCRIPTION OF PREFERRED EMBODIMENTS

Figure 1:
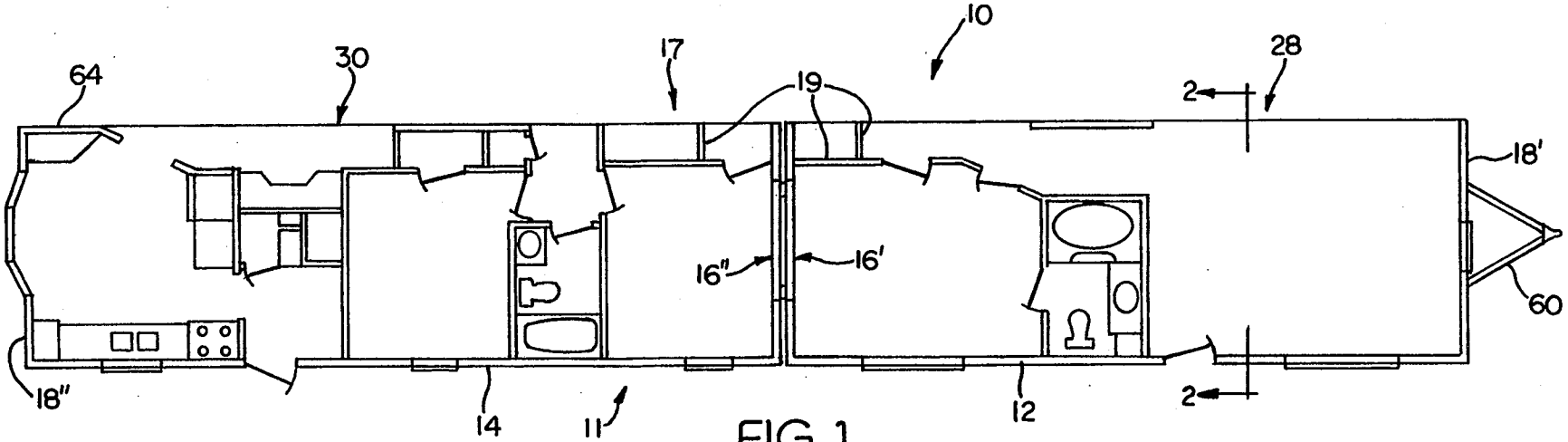
FIG. 1 is a top, floorplan view of a manufactured house unit incorporating the present invention, as in a shipping position.

FIG. 1 shows, for example, a top floorplan view of manufactured house unit 10 according to a preferred embodiment of the present invention. In its unassembled configuration, house unit 10 comprises exterior wall 11, end wall 18', end wall 18", and an open side 17. Two end walls 16' and 16" divide house unit 10 into two discrete sections 28 and 30 and divide exterior wall 11 into two sections 12 and 14. Interior walls 19 divide house unit 10 into various rooms and closets.

Figure 2:
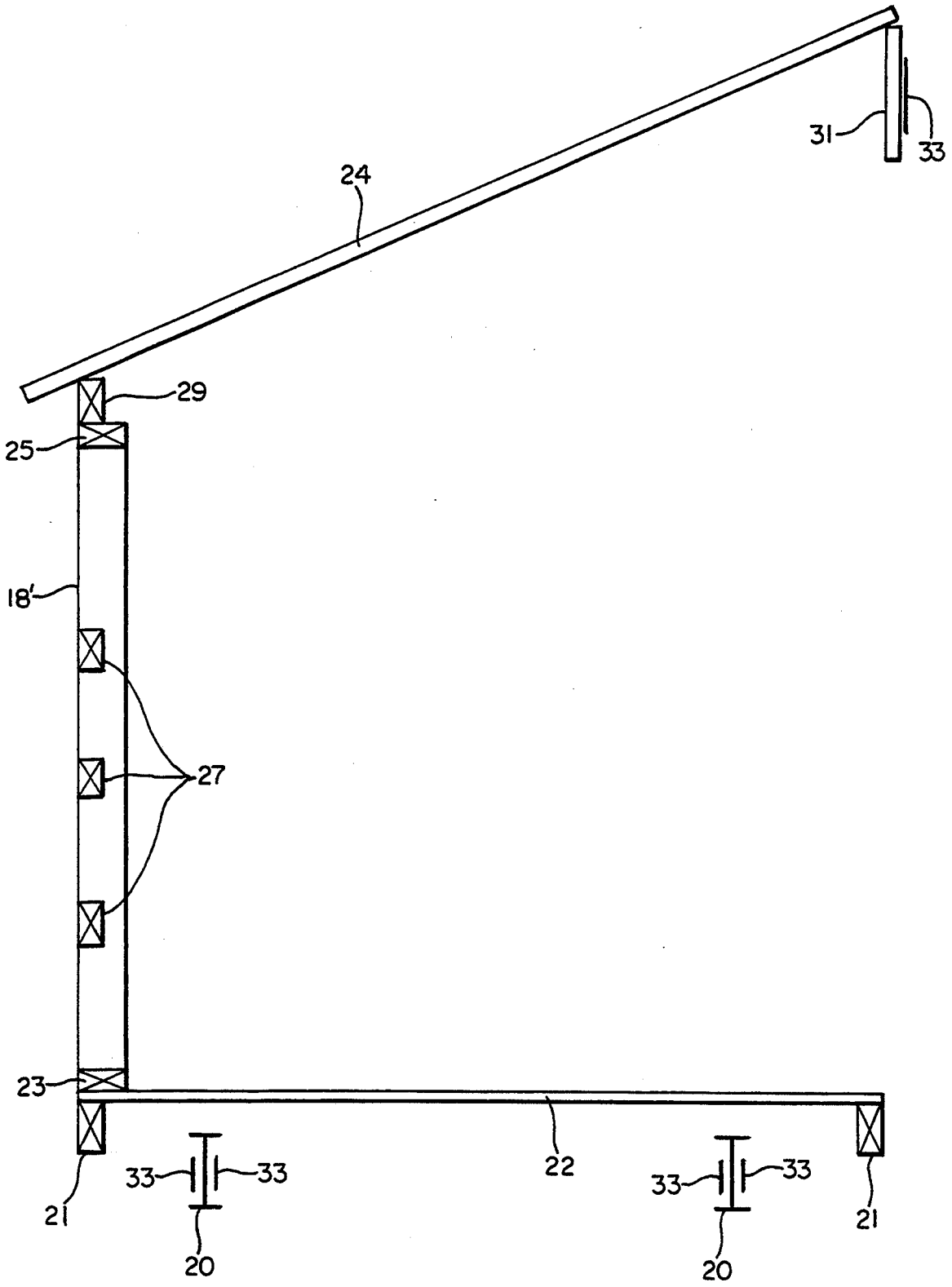
FIG. 2 is a cut-away end view taken along the line 2—2 in FIG. 1 showing the longitudinal structural members of the house unit.

During construction, floor 22 (FIG. 2) is assembled on perimeter floor joists 21. A seam 35 in floor 22 separates it into two sections between end walls 16' and 16". The entire floor structure rests on support beams 20. Exterior wall 11 is constructed on one side of floor 22 and comprises bottom plate 23, top plate 25, and a plurality of belt rails 27 running longitudinally therethrough. Exterior wall 11 also includes a series of vertical studs (not shown). End walls 18' and 18" are constructed in the usual manner and are disposed at opposite ends of exterior wall 11. End walls 16' and 16" are also constructed in the usual manner and are disposed a short distance apart within the interior of house unit 10. Roof deck 24 is constructed on top of house unit 10 and rests on facia board 29 and ridge beam 31.

As noted above, an advantage of the present invention is that it can be transported as a single unit. To provide the necessary stability for transportation as a single unit, house unit 10 is provided with a plurality of continuous structural members. Specifically, perimeter floor joists 21, bottom plate 23, belt rails 27, top plate 25, and facia board 29 are all continuous members running longitudinally the entire length of exterior wall 11. Additionally, support beams 20, although cut at a location between exterior walls 16' and 16", are spliced together with steel plates 33 to provide added support. Similarly, ridge beam 31 is also cut at a location between exterior walls 16' and 16" and spliced together with another steel plate 33.

Figure 3:
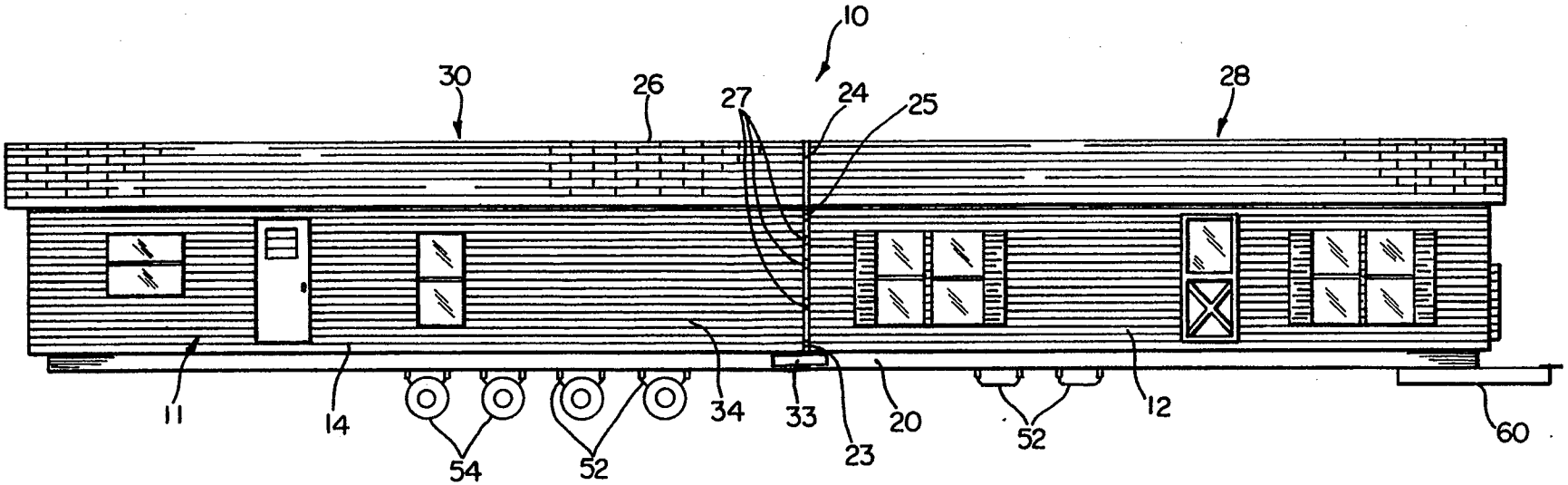
FIG. 3 is a right side view of the embodiment of FIG. 1, also as in a shipping position.

FIG. 3 shows a right side view of the floor plan for a manufactured house shown in FIG. 1. Exterior wall 11 is covered with siding or similar facia material 34. Roof deck 24 is covered with shingles 26. Four axle hangers 52 extend downward from support beams 20 underneath section 30 of house unit 10 and are equipped with axle and wheel arrangements 54. Two other axle hangers 52 extend downward from support beams 20 underneath section 28 of house unit 10. House unit 10 can be towed to the erection site without providing the second set of axle hangers 52 with axle and wheel arrangements. Towing hitch 60 is bolted to support beams 20 underneath section 28 of house unit 10 and extends outward therefrom.

Figure 4:
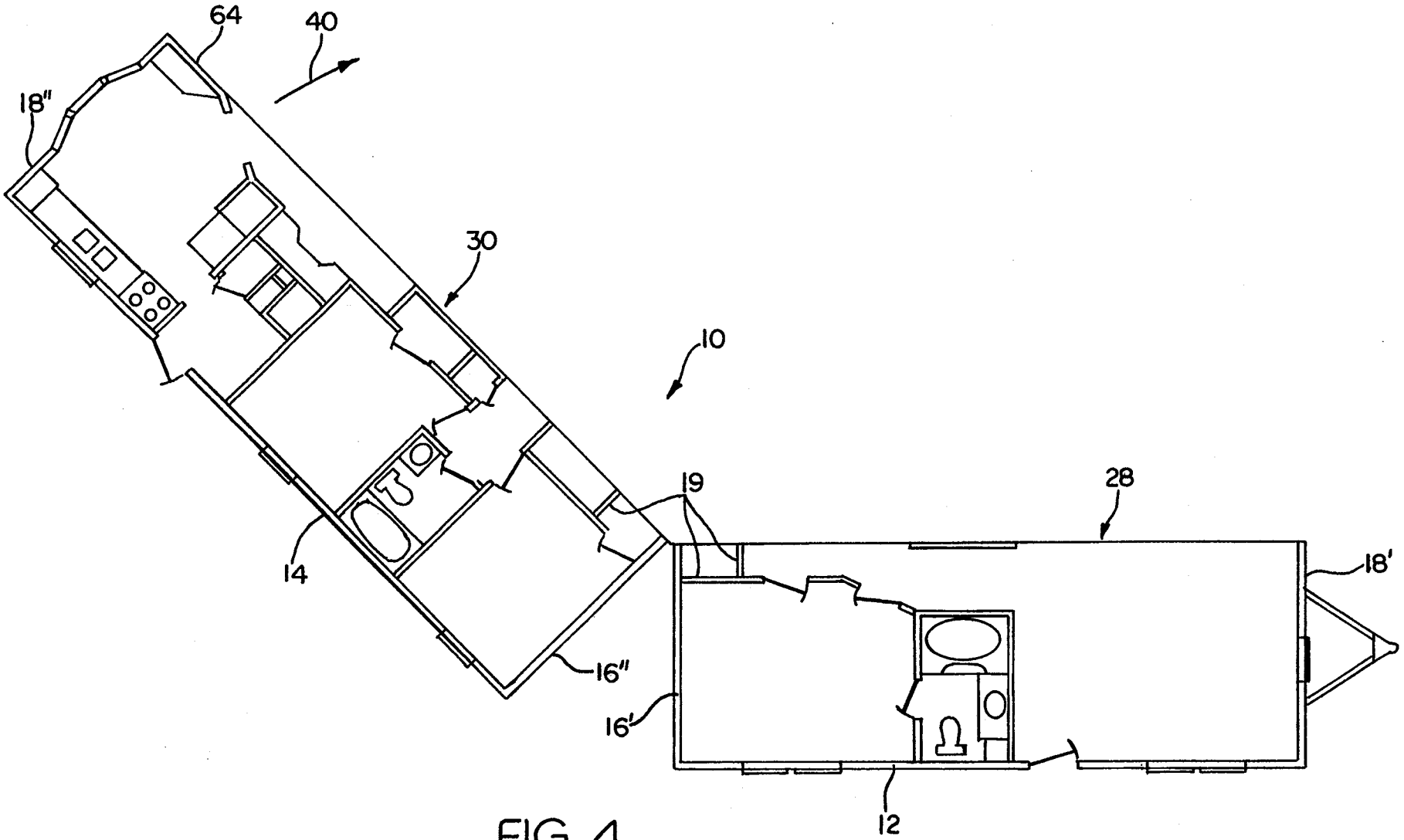
FIGS. 4–6 show in sequence the top floorplan views of the embodiment of FIG. 1 undergoing conversion from a shipping position to a finished position, as at the dealer or house erection site.
Figure 5:
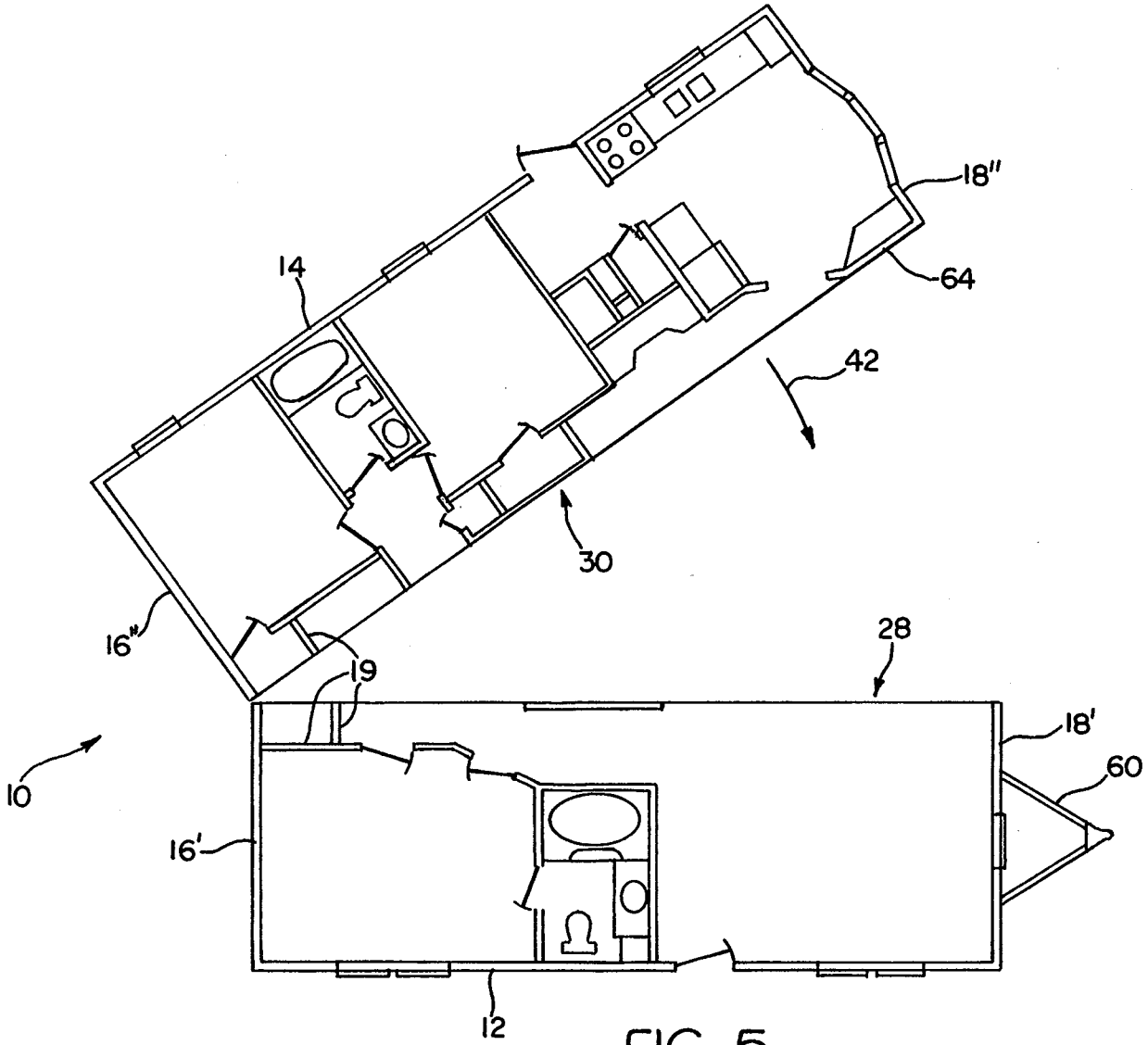
Figure 6:
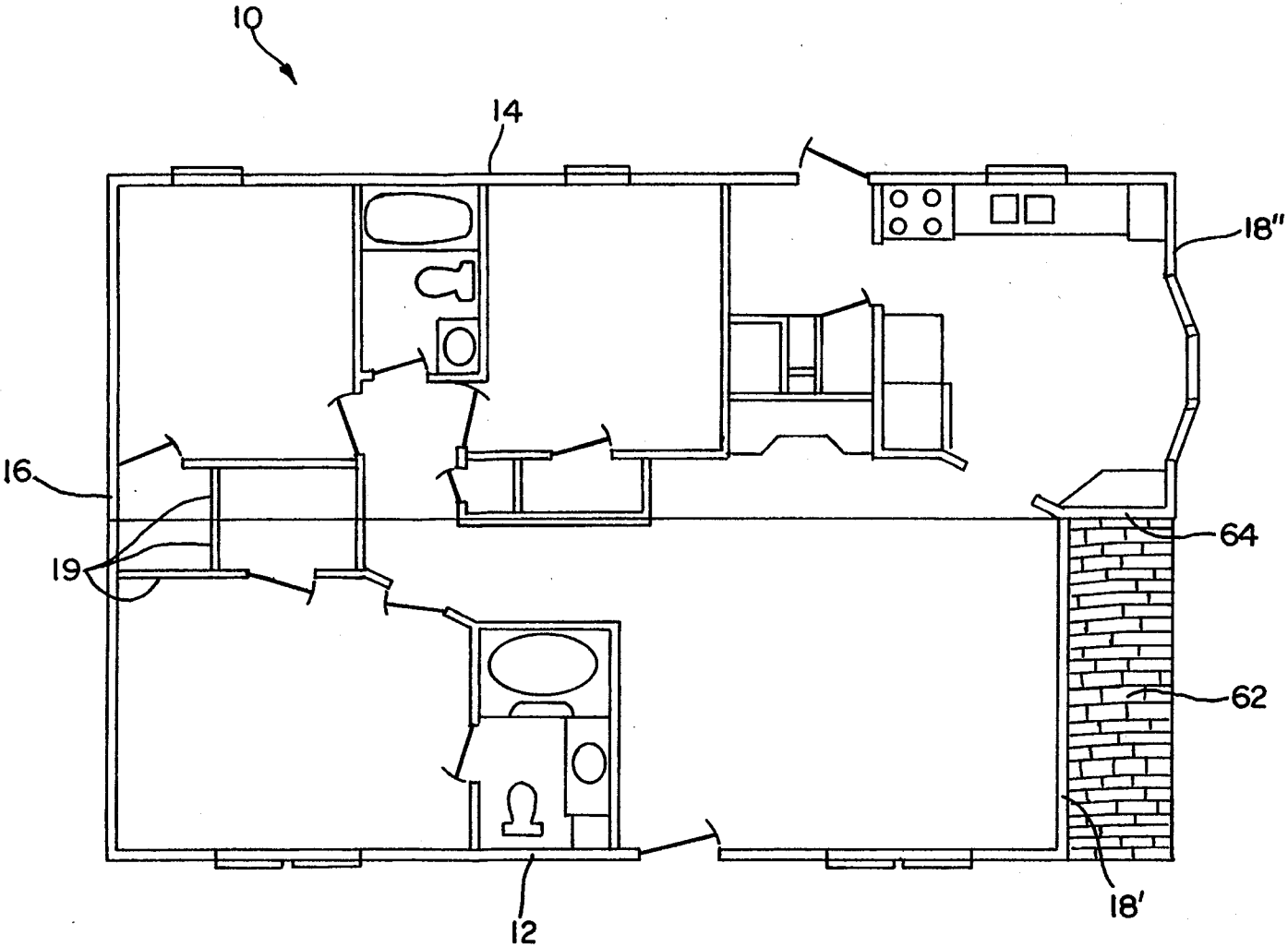

FIGS. 4–6 illustrate the conversion of house unit 10 from the shipping position to the finished house at the erection site. Briefly, to perform the conversion shown, plates 33 are removed and facia board 29, roof deck 24, floor joists 21, and top plate 25, belt rails 27 and bottom plate 23 of outer wall 11 are cut apart between intermediate end walls 16' and 16" to separate sections 28 and 30. As previously noted, floor 22 is already separated at this location. Towing hitch 60 is then moved to the end of section 30, and section 30 is pivoted in the direction of arrows 40 and 42 until sections 28 and 30 are mated together as shown in FIG. 6. Thus, intermediate end walls 16' and 16" form a single end wall 16. Similarly, end walls 18' and 18" comprise a second end wall, and interior walls 19 mate to form (in this floorplan) a closet. Also note that it is not necessary that section 30 be pivoted. Because section 28 is also equipped with axle hangers 52, axle and wheel arrangements 54 can be placed under section 28 to pivot it with respect to section 30. Because axle hangers 52, axle and wheel arrangements 54, and towing hitch 60 are moveable, they can be used in various combinations to facilitate placement of house unit 10 on sites of various shapes and sizes.

Furthermore, it is anticipated that towing hitch 60 will be advantageously placed with respect to a door in end wall 18 such that it can support (at least in part) a porch or patio deck 62 extending from such a door, as shown in FIG. 6. Also, if sections 28 and 30 are of different lengths, when mated together as shown in FIG. 6, deck 62 can form an integral part of the overall structure. In such arrangements, whichever section is larger would include a second exterior side wall 64. The length of side wall 64 would preferably be equal to at least the difference in the lengths of sections 28 and 30.

Figure 7:
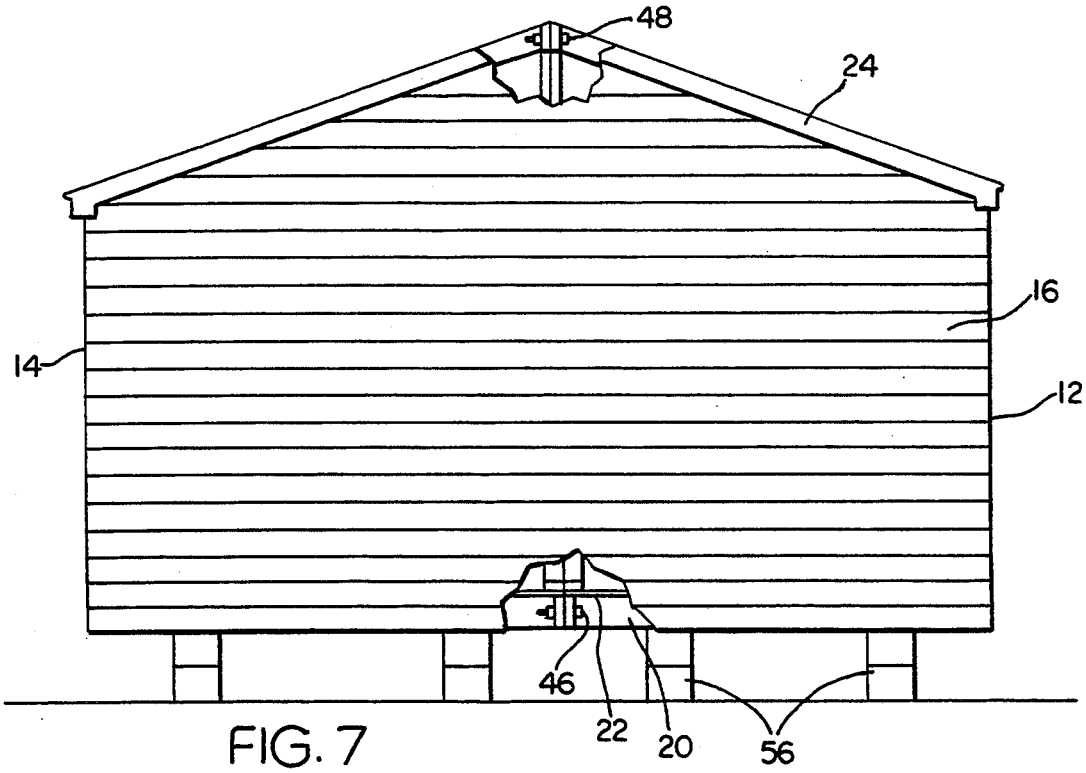
FIG. 7 is an end view of the embodiment of FIG. 2 in the finished position of FIG. 6 with portions thereof cut away to illustrate connections.

After sections 28 and 30 of house unit 10 are mated, they are joined together by fasteners 46 and 48 as shown in FIG. 7. Other common joining and seam sealing operations follow. For example, end walls 16' and 16" are not sided until after they are mated to form end wall 16. End walls 18' and 18" and side wall 64 can be sided before shipment or after. However, if sections 28 and 30 are of the same length, end walls 18' and 18" would mate to form a single end wall 18, which would be sided after mating.

In the illustrated example, house unit 10 is delivered to the homesite for erection, and axle hangers 52 and axle and wheel arrangements 54 are removed when support beams 20 are set on vertical pilings 56. The provision of separate axle hangers 52 for each of sections 28 and 30 allows each section to be independently transported after separation if necessary.

These drawings illustrate house unit 10 as being constructed according to the HUD code as manufactured housing, wherein support beams 20 also form the chassis upon which house unit 10 is towed. However, the same principles can be applied with other types of manufactured buildings, such as where BOCA codes are applicable and a reusable chassis is employed which is not separable at the erection site. Another application example is for manufactured housing having a perimeter frame for mounting over a basement.

Figure 8:
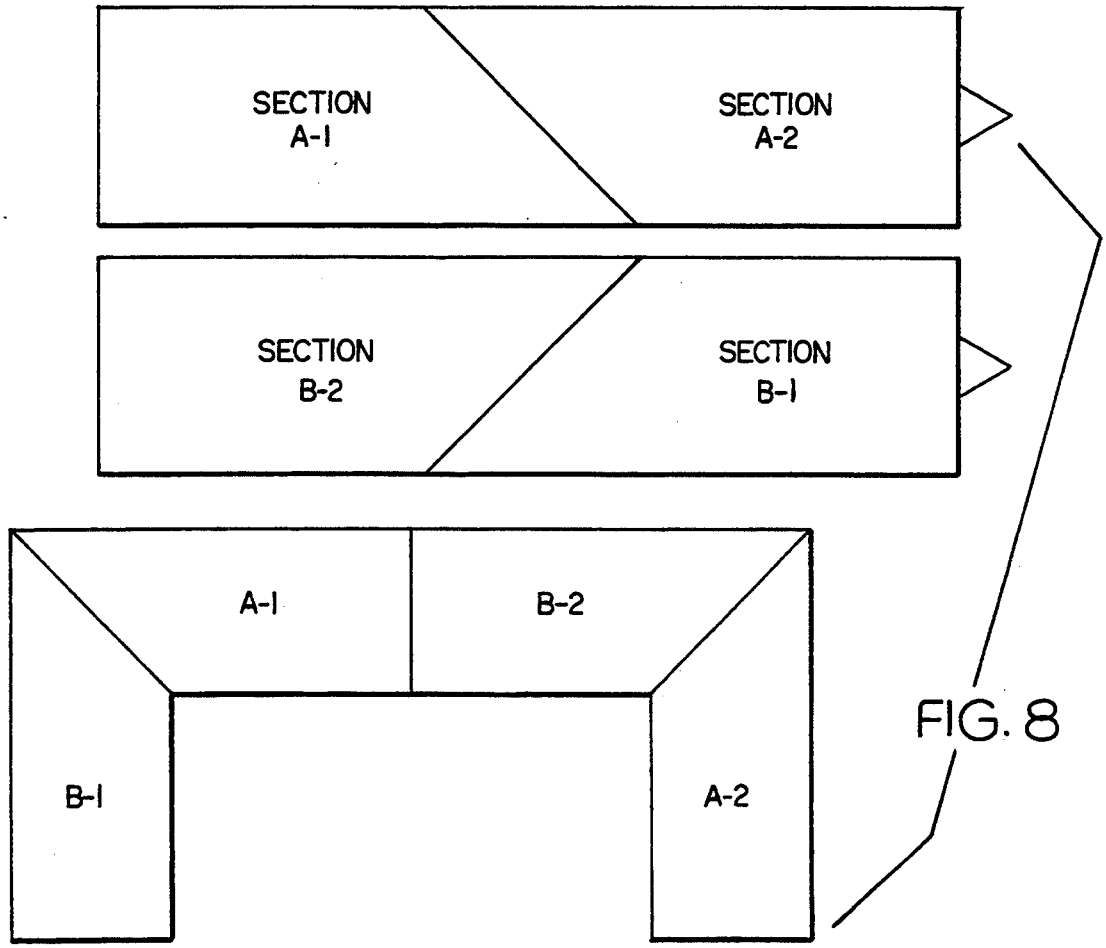
FIG. 8 shows a top view of another embodiment of a manufactured house unit according to the present invention in both shipping and assembled position.

Although the foregoing description illustrates the invention applied to a manufactured house having only two sections, the invention can also be applied to housing consisting of more than two sections, as was previously noted. Such a house is shown in FIG. 8. In this embodiment, unit A is divided into sections A-1 and A-2, and unit B is divided into sections B-1 and B-2. The units are transported and separated as described above. However, in this embodiment, section A-1 mates with section B-1 at one end and section B-2 at the other. Section A-2 mates with the other end of section B-2. Other sectional configurations may also be utilized.

Producing sectional manufactured and modular housing in this manner not only simplifies transportation concerns, but also reduces the assembly line space needed at the factory. Also, inventory control is streamlined at the factory and dealer lots since the two sections can be kept together at all times. Further, a greater variety of housing configurations are available at reduced costs.

Although the present invention has been described above in detail, the same is by way of illustration and example only and is not to be taken as a limitation. The scope and spirit of the present invention are limited only by the terms of the claims appended hereto.

What is claimed is:

1. A manufactured house formed from a plurality of sections matingly connected to form at least one enclosure therebetween, comprising:

a first pair of sections initially formed with a common structural member that is adapted to be subsequently separated to allow movement of the sections independent of each other; and a second pair of sections initially formed with a common structural member that is adapted to be subsequently separated to allow movement of the sections independent of each other, one section of said first pair being matable with both sections of said second pair, and one section of said second pair being matable with both sections of said first pair.

2. The process of assembling at an erection site a manufactured house unit having a first section and a second section joined by a common structural member, comprising the steps of:

cutting said common structural member to separate said first and second sections; and moving said first and second sections relative to each other such that an enclosure is created between them.

3. The process according to claim 2, further including the step of bonding and sealing said first and second sections together.

4. The process according to claim 2, wherein said manufactured house includes a towing hitch extending longitudinally from one end thereof and including the further step of constructing a patio platform on said towing hitch.

5. The process according to claim 2, wherein said manufactured house unit includes a roof deck and further comprising the step of cutting said roof deck.

6. The process according to claim 2, wherein said manufactured house unit includes perimeter floor joists and further comprising the step of cutting said perimeter floor joists.

7. The process of assembling at an erection site a manufactured house unit having a longitudinally extending exterior side wall, an exterior end wall at each end of said exterior side wall, and two adjacent exterior end walls disposed intermediate the ends of said exterior side wall and being separated by a divisible portion of said exterior side wall, comprising the steps of:

cutting said divisible portion to separate said unit into at least two sections and to divide said exterior side wall into at least two segments;

moving said sections relative to each other such that an enclosure is created between said end walls and each segment of said exterior side wall; and bonding and sealing each section in that position.

8. The process according to claim 7, wherein said manufactured house includes a towing hitch extending longitudinally from one end thereof and including the further step of constructing a patio platform on said towing hitch.

9. The process according to claim 7, wherein said manufactured house unit includes a roof deck and further comprising the step of cutting said roof deck.

10. The process according to claim 7, wherein said manufactured house unit includes perimeter floor joists and further comprising the step of cutting said perimeter floor joists.

* * * * *